United States Patent [19]

Adams et al.

[11] 4,048,541

[45] Sept. 13, 1977

[54] CRYSTAL CONTROLLED OSCILLATOR CIRCUIT FOR ILLUMINATING ELECTRODELESS FLUORESCENT LAMP

[75] Inventors: Guy Adams, Monroe; Scott D. Goldman, Monsey, both of N.Y.

[73] Assignee: Solitron Devices, Inc., Tappan, N.Y.

[21] Appl. No.: 695,852

[22] Filed: June 14, 1976

[51] Int. Cl.[2] ..... H05B 41/16; H05B 41/24

[52] U.S. Cl. ..... 315/248; 315/267; 315/283; 315/344

[58] Field of Search ..... 315/248, 267, 283, 344

[56] References Cited

U.S. PATENT DOCUMENTS

| | | | |
|---|---|---|---|
| 3,109,960 | 11/1963 | Bell et al. | 315/248 |
| 3,196,312 | 7/1965 | Marrison | 315/248 X |
| 3,227,923 | 1/1966 | Marrison | 315/248 |
| 3,500,118 | 3/1970 | Anderson | 315/248 X |
| 3,521,120 | 7/1970 | Anderson | 315/248 |
| 3,745,410 | 7/1973 | Fletcher et al. | 315/248 |
| 3,860,854 | 1/1975 | Hollister | 315/248 |
| 3,873,884 | 3/1975 | Gabriel | 315/267 |

*Primary Examiner*—Saxfield Chatmon, Jr.
*Attorney, Agent, or Firm*—Richard G. Geib

[57] ABSTRACT

A power supply circuit having a crystal controlled solid state oscillator induction coupled to a dual transistor circuit so as to eliminate second harmonics in a coil connected thereto and to a power supply in completing the circuit, and coil further having a resonance circuit therearound. Such power supply being suitable for driving a plasma gas envelope.

3 Claims, 2 Drawing Figures

CRYSTAL CONTROLLED OSCILLATOR CIRCUIT FOR ILLUMINATING ELECTRODELESS FLUORESCENT LAMP

BACKGROUND

Recently interest has again been noted to provide a more efficient lighting source as by an electrodeless fluorescent lamp which can be mounted in the familiar Edison base.

Attempts to provide such devices have been noted in the prior at to include U.S. Pat. Nos. 2,149,414, 2,349,012, 3,500,118, 3,521,120 and 3,873,884 to note a few more representative teachings.

All of these devices have attempted to provide energy from a magnetic field of a predetermined frequency to ionize a gas to activate a fluorescent material and produce light thereby. The object of all these prior art attempts have been to produce light at a high conversion efficiency (lumens/watt).

All of these prior art devices generate radiant energy in the form of an oscillation of varied frequencies dependent on design parameters of each. Another way of stating this is that such devices radiate a damped wave modulated by the supply source frequency that can set up disturbing radio frequency interference (RFI).

The Federal Communications Commission (FCC) has permitted certain frequency bands to be used with greater liberality than others. However, it has been the practice of prior art practitioners to use much higher frequencies of the order of 100Kc to 500Kc and in the more recent times as low as 27.12MHz.

It is with knowledge of this background that this invention was realized.

SUMMARY

It is a detailed object of this invention to inductively couple a crystal controlled oscillator to a Class D amplifier, avoiding second harmonic problems and creating a radio frequency drive for a coil of the order of approximately 13.56MHz ± 6.8MHz.

A further explanation of the objects of this invention is to drive a crystal controlled solid state oscillator from a 120VAC source and provide an amplified frequency output therefrom to a grounded coil that will drive the base of a pair of transistors having high energy breakdown resistance to a conductive state at a frequency of 13.6MHz ± 6.8KHz whereby a magnetic field is created in a coil connected in series with said source and said transistors.

A further recitation of the object of this invention is that the paired transistors aforesaid are arranged to have their emitters connected to a center tap of the coil controlling the base shunted by a capacitor and resistor in parallel with a ground connection which center tap is connected to the respective bases by diode means tapped thereinto before the coil.

It is also an object of this invention to provide means to broadcast said magnetic energy of the coil above same by an antenna extension therefrom.

DRAWING DESCRIPTION

FIG. 1 is a schematic circuit diagram of the circuit for creating energy in a coil according to this invention; and FIG. 2 is a cross sectional diagram of a package for such a circuit shown in block form therein as will enable a use of same.

DETAILED DESCRIPTION

Figures 1, 2:
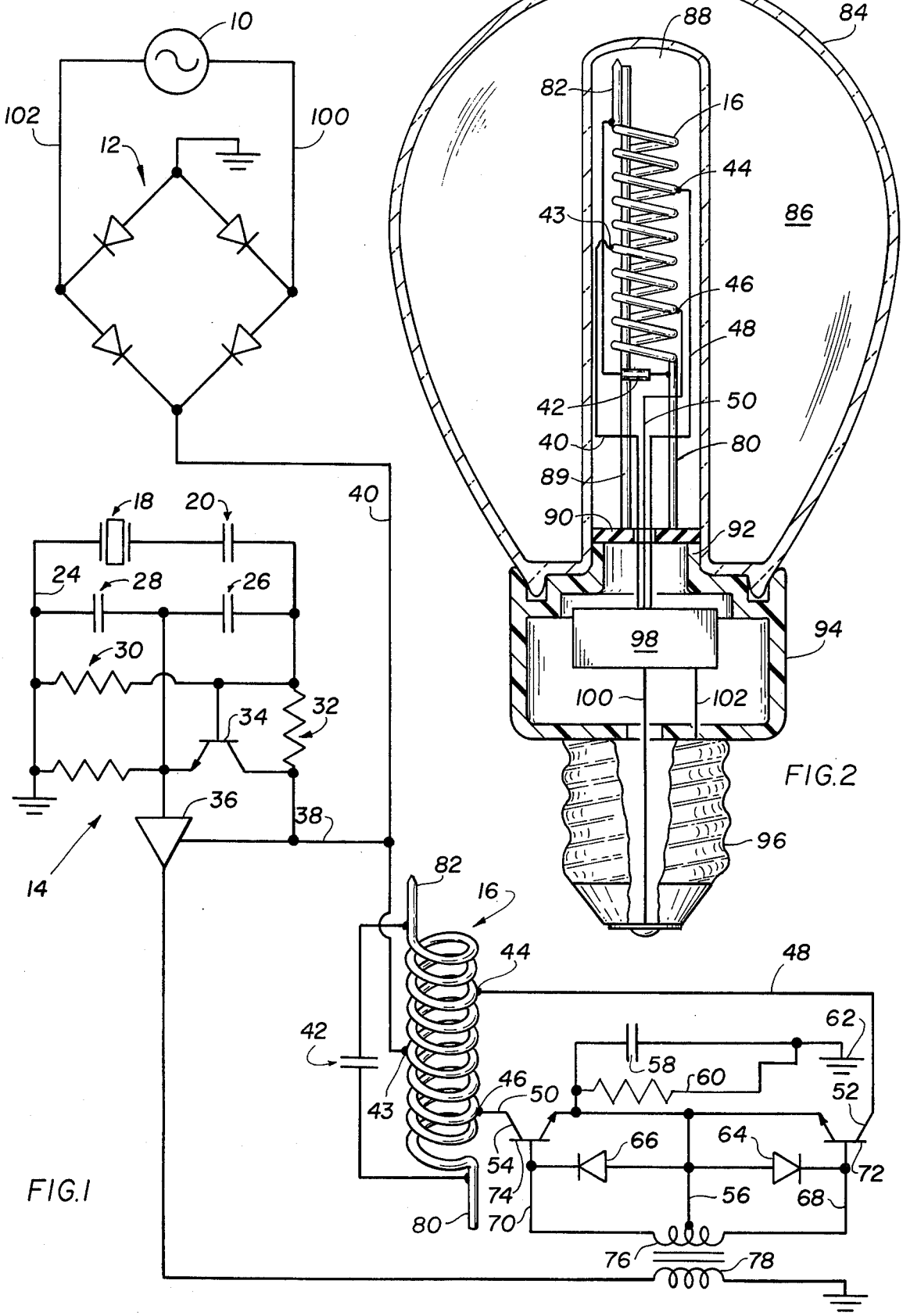

With regard to FIG. 1 thre is shown an AC source 10, typically 120V domestic house current, connected to a bridge network 12 as will be readily familiar to one skilled in the art. The output of the bridge network is split to oscillator circuit 14 and coil 16.

Considering the oscillator network first there is shown a crystal 18 with a capacitance 20 connected between source lead 22 and a source lead 24. This with the series network of capacitors 26 and 28 and a resistance lead with a resistance 30 plus resistance 32 will control the bias of base 34 to provide an output to amplifier 36 having control lead 38 connected to the source lead 40 for the oscillator circuit.

The output of the bridge network is also provided via lead 40 to a center tap 43 of coil 16. As seen coil 16 has a resonance circuit in capacitor 42 across the ends thereof which may be a variable capacitance if desired.

The coil 16 is also provided with connections 44 and 46 for leads 48 and 50 from collectors 52 and 54 of two transistors such as NPN epitaxial planar power transistors known in the assignees product line chip catalog as element number 91. As shown the emitters of these transistors are joined to a center lead 56 with a capacitor 58 and resistor 60 in parallel to a source connection 62. The center lead 56 is further tapped by diodes 64 and 66 connected between it and leads 68 and 70 to the bases 72 and 74 of the transistors from opposite ends of coil 76 which is inductively related to a coil 78 for the output of the amplifier 36. Coil 16 has antennas 80 and 82 so as to increase the height of the field generated.

With reference to FIG. 2 there is shown an envelope 84 such as a glass bulb, having a phosphorous liner on its inner walls, enclosing a chamber 86 having a gaseous argon - mercury mixture. A central chamber 88 is open to atmosphere so as to receive coil 16 centrally of chamber 86, the coil body is located approximately central to the greatest cross sectional area of the bulb by means of a support 89 bonded to antenna 82 to sit on, with antenna leg 80 a non-conductive ring 90, itself resting on a projecting flange 92 of a housing 94 having an Edison base 96. The leads 40, 48 and 50 being fed through a central opening in ring 90.

The electronics of FIG. 1 are within the block 98 with leads 100 and 102 being the source connections.

We claim:

1. In an electrodeless bulb having a sealed chamber about a cavity leading to a base member adapted to mate with a conventional incandescent lamp socket, a circuit to excite a coating on the inner walls of the bulb by causing radiation of a fluid in said sealed chamber, said circuit comprising:

a coil having a predetermined number of turns located central to the major bulb area having a first length extending from the turns to a closure at the end of said cavity in the sealed chamber and a second length extending from the turns to a juncture of the cavity with the base member, said lengths being connected by a resonant circuit across said turns and said turns having connections at each end and intermediate the ends;

a voltage source;

a crystal controlled circuitry connected to said voltage source, said circuitry providing a voltage output at a frequency below 25 kc;

a class D amplifier circuit connected to the end connections of the turns of said coil;

a lead connecting the connection intermediate the ends to the voltage source; and an inductive couple of the crystal circuitry and class D amplifier circuit.

2. A high frequency power source for electrodeless actuation of a plasma gas envelope, said power source comprising:

a power supply;

a wheatstone bridge circuit for the output of said power supply;

a crystal oscillator connected to said bridge circuit and to said power supply, said crystal oscillator including a circuit concluding in a transistor control of an output frequency;

a current regulated amplifier means receiving said output frequency, said amplifier means being connected to said power supply for the current regulation thereof of its output cycle;

a coil means having a number of turns between antenna means that increase the length of the field generated to encompass the plasma gas envelope, said coil means having an intermediate turn thereof connected to said bridge circuit and four other connections, one at each antenna means and one each on two turns inwardly of said antenna means at opposite ends spanning said intermediate turn;

a class D amplifier connected inductively to said current regulated amplifier means, said class D amplifier having separate outputs for separate connection to said turns inwardly of said antenna means spanning said intermediate turn so as to provide a signal on every portion of the output cycle due to the separate outputs being connected to the said two of said four other connections; and a resonance circuit connecting the antenna means by being connected between the remaining two of said four other connections.

3. In an electrodeless bulb a means to activate a mercury gas to cause glowing of a phorphorous coating, said means comprising:

a source of electrical energy;

a crystal connected across said source in series with a capacitor and a resistor;

a series capacitance tapped between said capacitor and resistor across said source in parallel with the said crystal and capacitor;

a resistance lead across said source also tapped between said capacitor and resistor in parallel with the said crystal and capacitor;

a resistance lead across said source tapped between said capacitor and resistor to be also in parallel with the said crystal and capacitor and the series capacitance a transistor having a base, collector and emitter, said base being tapped to said resistance lead at its input from said resistor from said source, said collector being connected directly to one side of the source to receive electrical energy, said emitter being connected to an output terminal and also being connected to the other side of the source by a resistance and to said series capacitance by a lead;

a means to amplify signals from the output terminals;

an inductive coupler for the means to amplify;

a means to create a magnetic field connected to said means to amplify by said inductive coupler, said means to create a magnetic field being operative on both the rising and falling edges of signals from the inductive coupler;

a coil means connected to said means to create a magnetic field to broadcast same by a main coil portion extended by antenna ends to provide a maximum field length; and an envelope to be illuminated by the magnetic field, said envelope having one chamber for said coil and another chamber for a mercury gas mixture, said another chamber having phosphorous coated walls and said one chamber being internally of and separate from the other chamber to permit assembly and disassembly of said envelope to said coil means which on assembly is in said one chamber.

* * * * *